US006477775B2

(12) United States Patent
Scribner et al.

(10) Patent No.: US 6,477,775 B2
(45) Date of Patent: Nov. 12, 2002

(54) DEVICE AND METHODS FOR OPENING CLOSED CONTAINERS

(76) Inventors: Dale Scribner, 6830 Arabella Way, Sacramento, CA (US) 95831; John Schwaner, 757 Parkhaven Way, Sacramento, CA (US) 95831

( * ) Notice: Subject to any disclaimer, the term of this patent is extended or adjusted under 35 U.S.C. 154(b) by 0 days.

(21) Appl. No.: 09/751,867

(22) Filed: Dec. 28, 2000

(65) Prior Publication Data

US 2002/0083590 A1 Jul. 4, 2002

Related U.S. Application Data

(60) Provisional application No. 60/176,237, filed on Jan. 14, 2000.

(51) Int. Cl.[7] ..... B67B 7/46

(52) U.S. Cl. ..... 30/1.5; 30/416; 30/417

(58) Field of Search ..... 30/1.5, 2, 400, 30/416, 417, 430, 278, 294, 92, 96, 101, 102, 95, 442, 435, 431, 432, 429, 418; 7/156; 81/3.07, 3.09, 64, 65, 3.43, 3.4, 177.7, 65.2

(56) References Cited

U.S. PATENT DOCUMENTS

| | | | | | |
|---|---|---|---|---|---|
| 810,984 | A | * | 1/1906 | Smith | 30/1.5 |
| 999,668 | A | * | 8/1911 | Montaperto | 30/1.5 |
| 1,491,477 | A | * | 4/1924 | Hawley | 30/417 |
| 1,494,194 | A | * | 5/1924 | Smith | 30/416 |
| 2,061,459 | A | * | 11/1936 | Forman, Sr. et al. | 30/1.5 |
| 2,562,055 | A | * | 7/1951 | Miller | 72/292 |
| 2,674,911 | A | * | 4/1954 | Theis | 81/3.44 |
| 3,025,597 | A | * | 3/1962 | Huglin | 30/91.2 |
| 3,722,327 | A | * | 3/1973 | Strassel | 81/3.1 |
| 3,900,948 | A | | 8/1975 | Kammeraad | |
| 4,155,160 | A | * | 5/1979 | Bobo | 30/435 |
| 4,279,077 | A | | 7/1981 | Freeman | |
| 4,845,844 | A | * | 7/1989 | Allen | 30/1.5 |
| 5,133,234 | A | | 7/1992 | Ehlert | |
| 5,181,322 | A | * | 1/1993 | Koo | 30/416 |
| 5,197,197 | A | * | 3/1993 | Himmighofen et al. | 30/416 |
| 5,205,195 | A | | 4/1993 | Crosslen et al. | |
| 5,653,023 | A | * | 8/1997 | Andina | 30/1.5 |
| 5,659,963 | A | * | 8/1997 | McCrady | 30/1.5 |
| 5,740,612 | A | * | 4/1998 | Takeshita et al. | 30/1.5 |
| 6,151,779 | A | * | 11/2000 | Brown | 30/1.5 |

OTHER PUBLICATIONS

Operating Instructions Champion Oil Filter cutter, Copy of instructions enclosed in packaged tool.

* cited by examiner

*Primary Examiner*—Hwei-Siu Payer
(74) *Attorney, Agent, or Firm*—Bozicevic, Field & Francis LLP; Kelly J. McCrystle

(57) ABSTRACT

A device for opening a sealed container, the device comprising, a first arm having a proximal and distal end, a second arm having a proximal and distal end, a cutting device, and at least one guiding device, wherein the guiding device is disposed on one of the first and second arms. Furthermore, the guiding device is adapted to receive a double seam of a sealed container, thereby preventing the device from slipping.

19 Claims, 5 Drawing Sheets

DEVICE AND METHODS FOR OPENING CLOSED CONTAINERS

CLAIM OF PRIORITY

The present application claims priority to U.S. Provisional Patent Application Serial No. 60/176,237 filed Jan. 14, 2000, the entirety of which is herein incorporated by reference.

FIELD OF THE INVENTION

The present invention relates generally to the opening of closed containers and more specifically a device for cutting open filter containers.

BACKGROUND OF THE INVENTION

Over the years as the internal combustion engine has been improved upon so have the technologies available to determine wear within the engine without taking the engine apart. One popular method to determine the wear within an engine is to examine the particles that have become entrapped within oil filters which are fitted to the engines. Typically, an internal combustion engine will utilize oil as a lubricant and means for cooling the engine during operation. The oil is circulated throughout the engine by a pumping means. Though prior to recirculating, the oil is typically circulated through a filter means.

Over the years oil filters have become standardized. Although they may not be of the same dimensions, all filters are typically round in shape and are formed of a outer metal body which encompasses a filter medium. Generally, anytime the oil in the engine is changed the filter is also changed. Usually this only requires that the filter be unscrewed from a standardized fitting on the engine and a new filter is screwed on.

A standard oil filter comprises a filter element constructed of a porous paper like material, the element is housed in a container. The container generally comprises two separate components, one being heavier steel and the other being of a lighter weight steel. In one embodiment the end portion constructed of the heavier steel includes a threaded aperture disposed in approximately the center thereof. In another embodiment the end portion constructed of the heavier steel includes a threaded member extending from approximately the center and having a bore disposed therethrough. It is either the aperture or threaded member which effectuates attachment to the engine block and communication with the oil to be filtered. To assemble a filter, the element is place within the lighter cylindrical steel container and then the heavier steel end is attached by mechanical means. The methods utilized to attach the two halves together creates a groove about the circumference of the filter, this groove is generally referred to as a double seam. Also, in particular, filters for use in aviation applications further include a hexagonal protrusion extending above the surface of the distal end of the lighter weight steel body.

As mentioned prior, there is an interest in removing the filter element from the body after use to inspect the particles trapped within the filter element. This is especially applicable in the aviation industry where as part of routine servicing the filter elements of the engine(s) are inspected to determine the condition of the engine and whether there are impending signs of failure. Other industries such as, racing applications, heavy industrial and fleet managers may also utilize filter particle analysis to determine the condition of the engines so that maintenance schedule can be established and also to determine the lifespan of the engine.

An additional benefit is that the filter may now be recycled. In the past oil filters were merely disposed of. With the increasing concern for the environment, many oil filters are being recycled after use by separating the elements of the filter. There have been several attempts to produce a filter opening device, some of which work others of which do not. There is still a felt need, especially within the aviation community for a device which will open oil filters without damaging the filter element, contaminating the element with shavings or leaving sharp edges which pose a potential threat to the user.

As example of prior art devices which have been adapted for the use mentioned above is a standard pipe cutter. This device comprises a generally C-Shaped support member having disk shaped blades attached to either free end which rotate in a direction transverse to the long axis of the pipe or other object to be cut. A screw or similar advancing implement brings the blades closer together as the device is rotated around the object.

The pipe cutter is not desirable for use in cutting filters because of the lightness of the material in which the container is constructed of. Many times, before the cutter disk penetrates the surface of the filter the cylindrical body of the filter crushes under the force applied by advancing the blade with the screw.

Another example of a prior art device is one that is specifically sold in the aviation industry and manufactured by Champion®. This cutter comprises a heavy steel body, upon which the distal end contains means for attaching the cutter to the filter to be cut. A cutter, mounted on a slidable carrier is then advanced toward the filter by a screw mechanism. After the cutter contacts the surface of the filter, the filter or cutter is then rotated, after making at least one full rotation, the cutting mechanism must be advanced again. The filter and/or cutter is then rotated round the circumference of the oil filter, this series of events must be repeated until the cutter penetrates the wall of the filter and the element can be removed. After cutting the filter, the detached end of the filter is retained by the cutter, the user must then carefully remove this from the cutter without cutting themselves on the sharp edge of the filter.

It is apparent that a need exists for a device which opens filters, specifically oil filters in a safe and efficient manner and wherein the operator can use the device without having to handle the filter excessively.

SUMMARY OF THE INVENTION

The present invention provides an apparatus and methods for severing and separating an oil filter into its principal components for analysis of the particles trapped within the filter element and for recycling purposes.

Upon removal of a used oil filter from an internal combustion engine, the filter is placed in a filter holder. On aircraft oil filters the distal end of the filter contains a hexagonal shaped protrusion. The filter hold contains a similarly shaped aperture which engages the extrusion on the filter. Thereafter, the cutter is adjusted to the size of the filter to be cut. After properly adjusting the cutter, the cutter arms are spread open, thereby allowing the user to dispose the cutter about end of the filter. The cutter arms are drawn toward the filter, whereby in the process the cutting means disposed on the cutter pierces the surface of the oil filter. The cutter is then rotated about the entire diameter of the filter thereby severing the filter. Once severed, the filter element can be removed from the casing, thereafter the casing can be discarded or recycled.

The apparatus of the present invention separates the metal casing, metal base plate and the inner filter element by making a single cut adjacent to the metal base plate of the filter.

In one embodiment of the invention the cutter further contains guiding means. The guiding means align the cutting means of the cutter and restrict the cutter to be rotated in one plane.

In another embodiment of the present invention the guiding means contain retention grooves that are specifically designed to grip the double seam disposed about the circumference of the oil can distal the metal base plate.

In another embodiment the location of the guiding means may be adjusted thereby adapting the cutter to various size filters and other sealed containers.

In another embodiment the cutter contains a safety mechanism to prevent the user from crushing the steel filter casing by applying to great a force to the cutter.

In another embodiment the a filter holder may be utilized with the filter holder.

The principal objects of the invention are therefore to provide a device to sever the casing of a internal combustion engine filter element; to allow analysis of particles entrapped within the filter element and to promote recycling of used filters.

A further object of this invention is to provide a device which is substantially safer to the user than existing devices.

Other objects and advantages of this invention will become apparent from the following description taken in connection with the accompanying drawings which set forth by way of illustration and example, certain embodiments of this invention. Additionally, although the description refers to oil filters of either automotive or aviation applications, the present invention may be utilized to severing and separating other types of substantially cylindrical containers.

An still further object of the present invention is to provide the user with a simple cutting device and holder mechanism that allows the user to separate the paper filter element from a sealed container by severing the metal container adjacent to and below the mounting flange of an oil filter.

DETAILED DESCRIPTION

Figure 1:
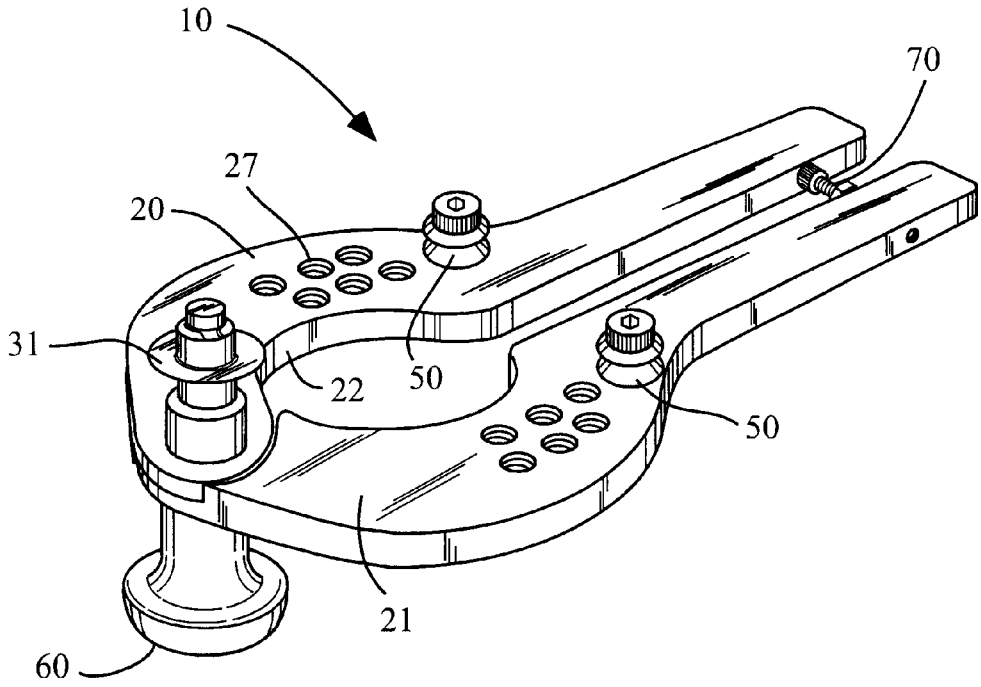
FIG. 1 is a perspective view of the cutting device of the present invention.

Reference is now made to the drawings wherein like numerals are used to designate like parts throughout. Referring now to FIG. 1, cutter 10 may be comprised of, first arm 20, second arm 21, cutting wheel assembly 31, at least one guiding device 50, handle 60 and limiting device 70.

Figure 2:
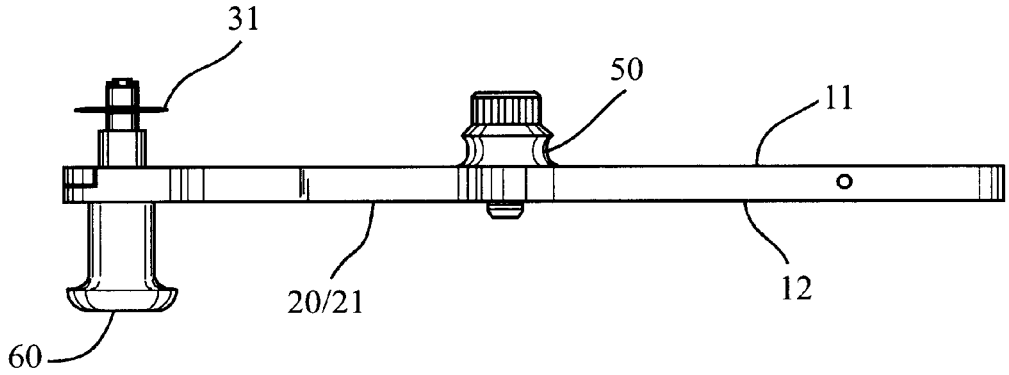
FIG. 2 is a side elevation of the cutting device of the present invention.
Figure 3:
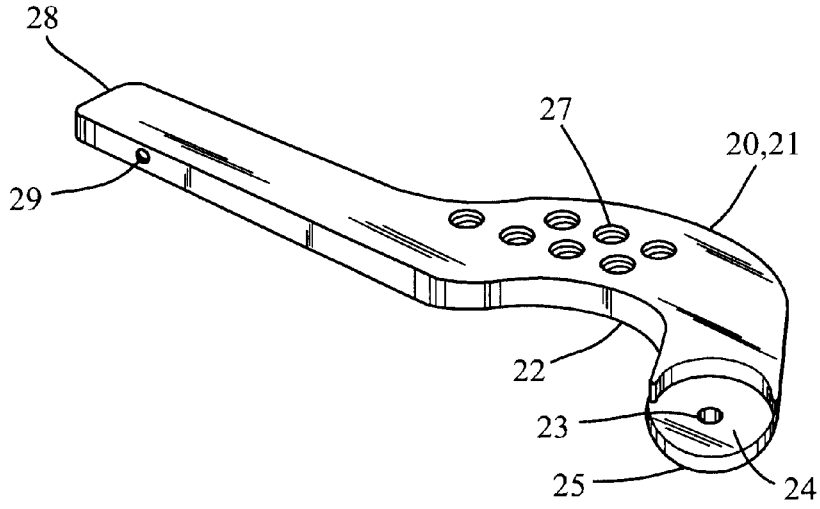
FIG. 3 is an illustration of the arm of the cutting device of the present invention.
Figure 4:
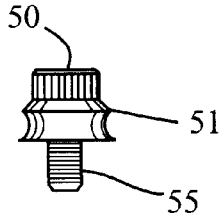
FIG. 4 is an illustration of the gripping device of the present invention.
Figure 5:
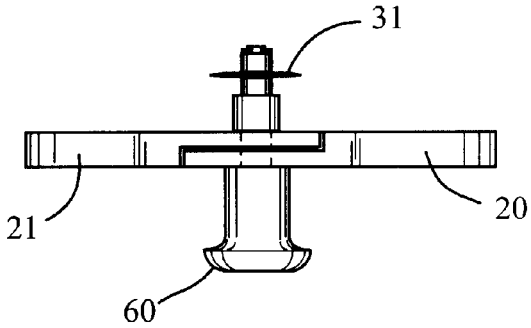
FIG. 5 is an illustration of the handle assembly and cutting device of the present invention.
Figure 6:
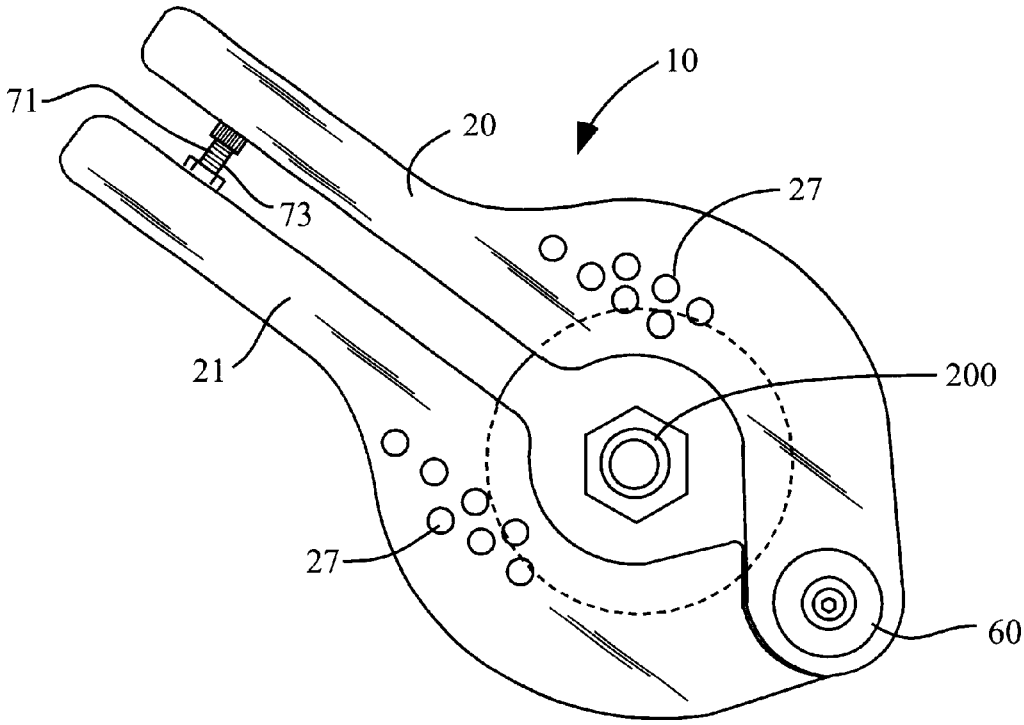
FIG. 6 is an elevated view of the present invention disposed about the proximal end of a closed container to be opened.

Referring to FIG. 2, cutter 10 has first side 11 and second side 12. Second side 12 having handle 60 disposed thereupon. As shown in FIGS. 1 and 2, first side 11 of cutter 10 having cutting wheel assembly 31 and guiding device 50 disposed thereupon. Cutter 10 comprises two generally arm(s) 20,21 as illustrated in FIG. 3. Arm(s) 20,21 contain at least one curved portion 22 adjacent to distal tip 25, whereby when assembled curved portion 22 creates an interrupted planar surface between arm 20 and arm 21, thereby allowing cutter 10 to be disposed about an oil filter 200 as illustrated in FIG. 6. As shown in FIG. 3 arm(s) 20,21 further comprise depressed region 24 adjacent to distal tip 25, whereby when assembled arm(s) 20,21 are disposed within a single planar surface. Arm(s) 20,21 further comprise at least one aperture 27 extending therethrough. Aperture 27 is disposed between distal end 25 and proximal end 28, more preferably proximal curved portion 22. Arm(s) 20,21 further contain aperture 29 disposed perpendicular to first surface 11 and second surface 12 adjacent to proximal end 28. Travel limiting device 70 may be disposed within aperture 29, whereby in use when cutter 10 is disposed about a container and force is exerted on arm(s) 20,21 drawing them together, travel limiting device 70 prevents the user from applying too great a force to arm(s) 20,21 thereby preventing the user from crushing or deforming the container which cutter 10 is disposed about.

Referring to FIG. 6, travel limiting device comprises a threaded body 71 and tightening mechanism 73. In use, threaded body 71 is disposed within aperture 29 on arm 20 or 21 and advanced to a desired depth. Tightening mechanism 73 disposed about the circumference of threaded body 71 is advanced until contact with arm 20 or 21, thereby the frictional interference between tightening mechanism 73 and arm 20 or 21 prevents threaded body 71 from advancing or retracting from arm 20 or 21.

Figure 7:
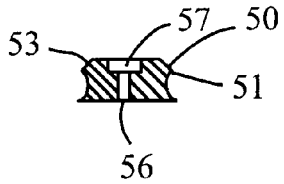
FIG. 7 is a side view of the gripping device shown in FIG. 4.

As shown in FIG. 1, cutter 10 further comprises at least one guiding device 50 rotatably attached to arm 20 or 21 and affixed to arm 20/21 through aperture 27. Guiding device 50 further contains lip 51. Lip 51 is specifically designed to receive the double seam on one end of an oil filter or other sealed container which contains a double seam. Guiding device 50 may be disposed upon first surface 11 of arm 20 or 21. Placement of guiding device 50 upon arm 20/21 may be varied thereby allowing cutter 10 to be configured for different size applications. Guiding device 50 is detachably attached to first surface 11 of arm 20,21 by bolt 55. Although, guiding device is shown and described as being attached to arm 20,21 by bolt 55, other methods of attachment have been contemplated such as utilizing a rivet, a removable pin or other similar devices. Referring to FIG. 7, guiding device 50 further contains aperture 56 disposed therethrough and bore 57 extending from proximal end 53. Bore 57 is sufficiently deep to accept the head of bolt 55. Aperture 56 is adapted to threadably receive the proximal end of bolt 55.

Figure 8:
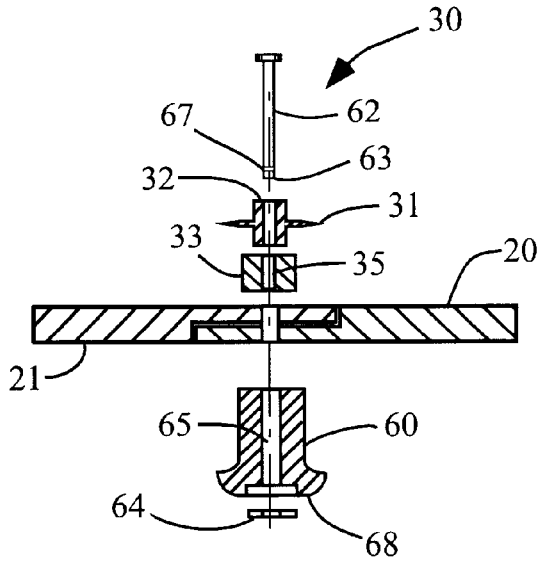
FIG. 8 is an exploded side view illustrating the handle assembly and the cutting device of the present invention.

Referring to FIG. 8, cutting wheel assembly 30. Cutting wheel assembly 30 comprises a cutting wheel 31, a cutting wheel carrier 33 , handle 60, and center support 62. As shown in FIG. 8 cutting wheel assembly 30 is assembled by passing center support 62 though a central bore 65 disposed in handle 60, through aperture 32 of cutting wheel 31 and aperture 35 of cutting wheel support 33 and aperture 23 of arm 20,21. Cutting wheel assembly 30 is detachably attached to cutter 10 by attachment device 64 disposed about distal end 63 of center support 62. Detachment device is preferably a c-clip that is received by groove 67 radially disposed adjacent to distal tip 63 of center support 62. Alternatively, distal end 63 may be threaded to receive a nut or other attachment device readily apparent to one skilled in the art. Thereby allowing replacement of the cutting wheel 31 of cutter 10.

Figure 9:
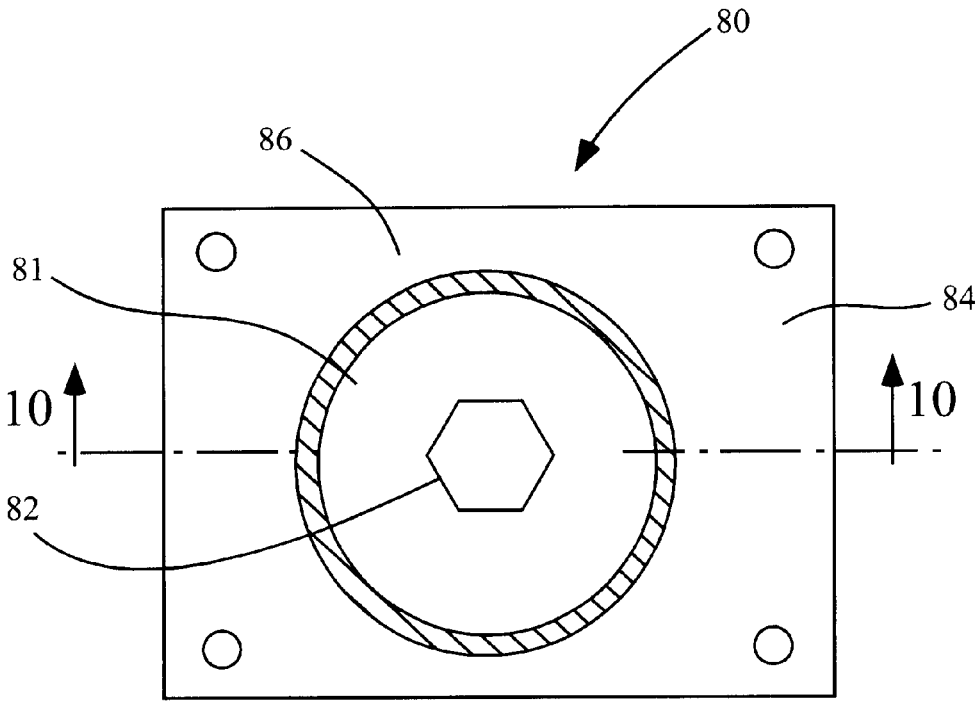
FIG. 9 is a top view of the container holder of the present invention.
Figure 10:
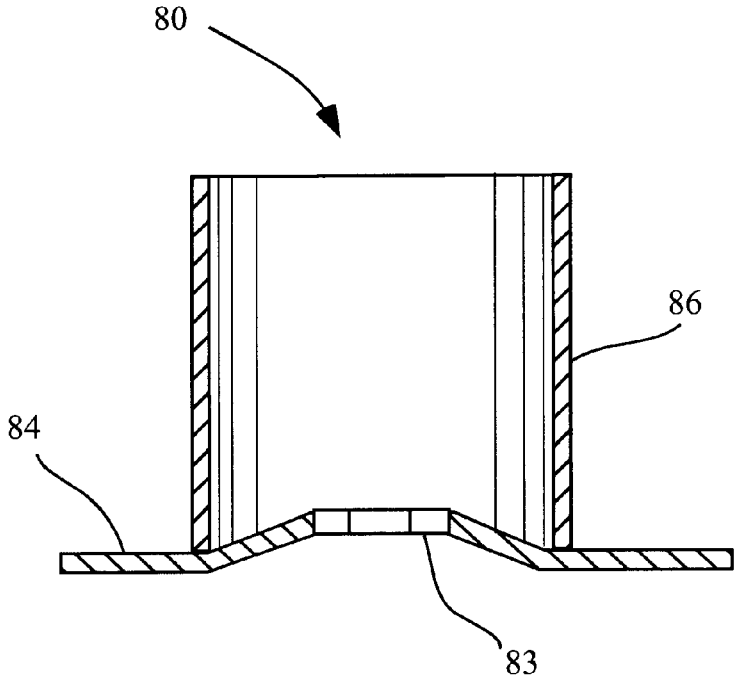
FIG. 10 is a cross-sectional view of the container holder shown in FIG. 9.
Figure 11:
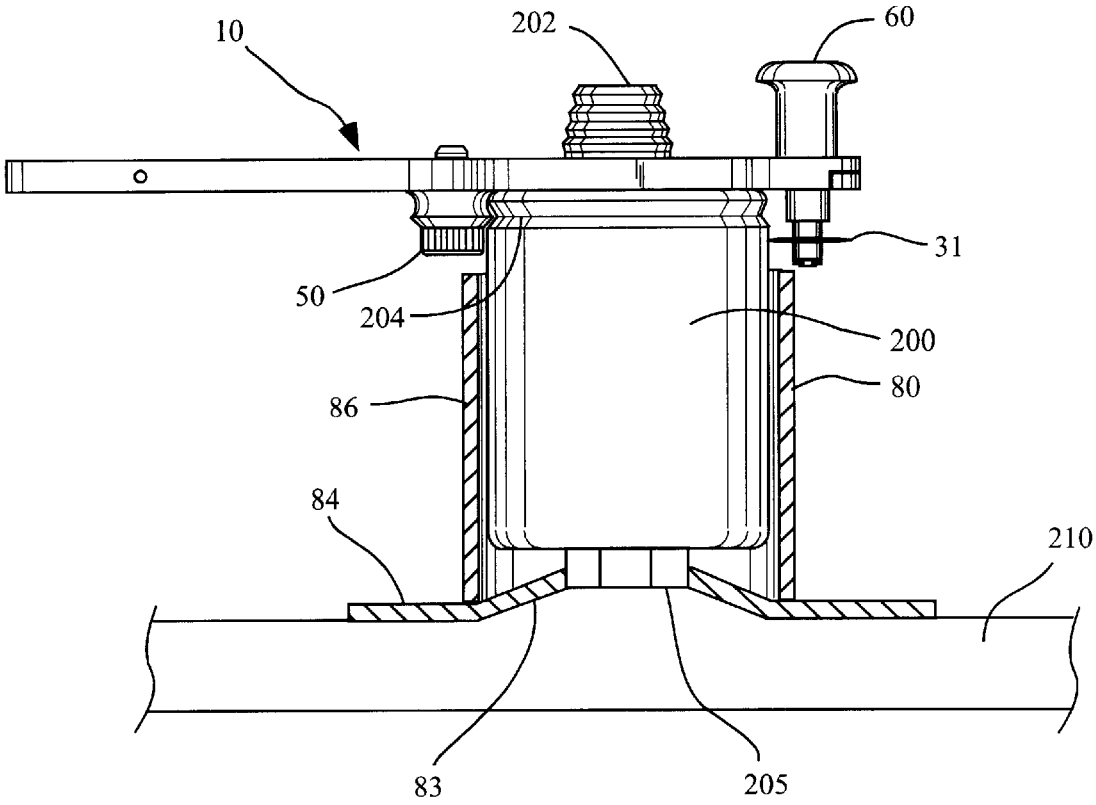
FIG. 11 illustrates the cutter of the present invention in use.

Referring to FIGS. 9,10 and 11, the container cutter of the present invention may further include filter holder 80. Filter holder 80 is specifically designed to retain oil filters. Filter holder 80 comprises main body 86 and plate 84. Main body 86 is generally cylindrical in shape and is of sufficient height to retain an oil filter. Main body may be constructed of many materials such as aluminum, plastic, composite materials, but is preferably constructed of a ferrous material such as steel.

Plate 84 is generally a flat plate constructed of a heavy, rigid structural material, such as steel. Plate 84 further contains aperture 82 substantially centered within plate 84. Aperture 82 is specifically formed to receive and retain the distal end of an oil filter element as illustrated in FIG. 11. Plate 84 further contains raised region 83 substantially centered in plate 84 and main body 86. As illustrated in FIG. 11, in use, raised region 83 provides sufficient clearance between the filter holder 80 and the surface 210 for the end protrusion 205 of oil filter 200.

In use, filter holder 80 is fixedly attached to a planar surface 210. An oil filter 200 is thereby disposed within bore 81 of filter holder 80, aligning the end protrusion 205 of filter 200 with aperture 82 such that aperture 82 retains filer 200 thereby resisting any torque applied to filter 200. Cutter 10 is then disposed about the proximal end of filter 200. Cutter 10 is shaped such as to provide clearance for protrusion 202 of oil can 200. Force is applied perpendicular to arm 20/21 thereby drawing the arm(s)together until limiting device 70 prevents further movement, thereby engaging cutting device 31 with the exterior surface of filter 200. Guiding device 50 grips the double seam 204 of oil filter 200 thereby restricting movement of cutter 10 to a single plane. Cutter 10 is thereby rotated about the circumference of the filter 200 thereby severing the filter casing into multiple pieces.

While this invention has been described and illustrated in conjunction with the best currently known embodiments, it will be obvious to those skilled in the art that modifications and variations may be made in it without departing from the spirit of the invention as disclosed and the scope thereof as set forth in the following claims.

We claim:

1. A cutting tool, comprising:

a first elongated element including an arcuate portion adjacent a first end, a handle portion adjacent a second end, and a depressed region including an aperture formed therein, said depressed region disposed at said first end;

a second elongated element including an arcuate portion adjacent a first end, a handle portion adjacent a second end, and a depressed region including an aperture formed therein, said depressed region disposed at said first end;

a pin extending through said apertures at said first ends of said elongated elements, wherein said depressed region of said first elongated element is configured to rotatably receive said depressed region of said second elongated element, when assembled said first and second elongated elements reside within a single plane, said first and second elongated elements pivotally coupled together by said pin;

a cutting blade rotatably disposed upon a first end of said pin;

a handle rotatably associated with a second end of said pin, wherein said handle element is configured to rotate independent of said cutting blade;

a first guide element rotatably positioned on said first elongated element; and a second guide element rotatably positioned on said second elongated element, wherein said first and second guide elements are absent any cutting edge.

2. The cutting tool of claim 1, wherein said elongated elements are flattened in shape, said flattened shape defining first and second sides for said cutting tool, said cutting blade located adjacent said first side, said handle located adjacent said second side.

3. The cutting tool of claim 1, further comprising an adjustable spacer associated with said handle portions of said elongated elements, said adjustable spacer configured to hold said elongated elements apart by an adjustable distance.

4. The cutting tool according to claim 1, wherein the elongated elements are constructed of a material chosen from the group consisting of aluminum, steel, or plastics.

5. A cutting tool, comprising:

first and second elongated elements, said first and second elongated elements pivotally coupled together with a pivot pin at a pivot point;

a cutting blade rotatably connected to said pivot pin; and first and second guides rotatably connected to said first and second elongated elements, said first and second guides disposed adjacent to said cutting blade, and wherein said first and second guides being absent of any cutting edge.

6. The cutting tool of claim 5, wherein said elongated elements each include a first end and a second end, said pivot pin associated with said first ends of said elongated elements, and first and said second elongated elements configured to reside within a single plane.

7. The cutting tool of claim 6, wherein said elongated elements each include an arcuate portion and a handle portion, said pivot pin located adjacent said arcuate portions of said elongated elements, and said first and second guides located adjacent to the handle portions of said elongated elements.

8. The cutting tool of claim 7, further comprising a handle associated with said pivot point, and said handle disposed opposite said cutting blade.

9. The cutting tool of claim 8, further comprising an adjustable spacer associated with said elongated elements and configured to hold said elongated elements apart by an adjustable distance, and said adjustable spacer disposed within the handle portions of the elongated elements.

10. The cutting tool of claim 5, wherein said first and second guides are adapted to receive a double seam of a sealed container.

11. The cutting tool according to claim 5, wherein the elongated elements are constructed of a material chosen from the group consisting of aluminum, steel, or plastics.

12. The cutting tool of claim 5, in combination with a filter holder device, the filter holder device including a substantially horizontal base including a concave portion formed therein and an aperture disposed within said concave portion and a generally cylindrical base projecting from said substantially horizontal element.

13. The combination according to claim 12, wherein the aperture of the filter holder device is a hexagon.

14. The cutting tool according to claim 5, wherein the cutting blade is replaceable.

15. A cutting tool configured for cutting open oil filters, comprising:

first and second elongated elements each including a handle portion and an arcuate portion, said first and second elongated elements further including a first and second surface, said elongated elements pivotally coupled together at a pivot point with a pivot pin, said pivot point located adjacent said arcuate portions;

a removable cutting blade associated with said pivot pin, wherein said cutting blade is disposed adjacent to the first surface of the first and second elongated elements; and first and second guides rotatably attached to said first and second elongate elements, said first and second guides projecting from said first surface, and said first and second guides being absent of any cutting edge.

16. The cutting tool of claim 15, further comprising a handle, said handle associated with said pivot point and located on a second side of said cutting tool, said handle being rotatably associated with said pivot pin disposed through said pivot point.

17. The cutting tool of claim 15, further comprising an adjustable spacer associated with said handle portions of said elongated elements, said adjustable spacer configured to hold said elongated elements apart by an adjustable distance.

18. The cutting tool according to claim 15, wherein said first and second guides are configured to receive a double seam of an oil filter.

19. The cutting tool according to claim 15, wherein the elongated elements are constructed of a material chosen from the group consisting of aluminum, steel, or plastics.

* * * * *